US010969158B2

(12) United States Patent
Lindel et al.

(10) Patent No.: US 10,969,158 B2
(45) Date of Patent: Apr. 6, 2021

(54) NO-FROST HOUSEHOLD REFRIGERATOR HAVING BAFFLE PLATE PROVIDING A SEAL IN RELATION TO THE BACK PANEL

(71) Applicant: BSH HAUSGERAETE GMBH, Munich (DE)

(72) Inventors: Andreas Lindel, Heidenheim (DE); Thomas Schaefer, Giengen (DE); Marcus Wehlauch, Nattheim (DE)

(73) Assignee: BSH Hausgeraete GmbH, Munich (DE)

( * ) Notice: Subject to any disclaimer, the term of this patent is extended or adjusted under 35 U.S.C. 154(b) by 59 days.

(21) Appl. No.: 15/833,019

(22) Filed: Dec. 6, 2017

(65) Prior Publication Data

US 2018/0156521 A1 Jun. 7, 2018

(30) Foreign Application Priority Data

Dec. 7, 2016 (DE) ..... 10 2016 224 389

(51) Int. Cl.

| | |
|---|---|
| ***F25D 23/06*** | (2006.01) |
| ***F25D 11/02*** | (2006.01) |
| ***F25D 17/06*** | (2006.01) |
| *F25D 21/06* | (2006.01) |

(52) U.S. Cl.

CPC ..... *F25D 23/069* (2013.01); *F25D 11/02* (2013.01); *F25D 17/062* (2013.01); *F25D 21/06* (2013.01)

(58) Field of Classification Search

CPC .... F25D 17/065; F25D 17/062; F25D 23/069; F25D 2400/04; F25D 11/02; F25D 23/066; F25D 23/067

USPC ..... 312/404, 408

See application file for complete search history.

(56) References Cited

U.S. PATENT DOCUMENTS 4,353,223 A * 10/1982 Dienemann ..... F25D 17/04 62/442
5,156,021 A * 10/1992 St-Gelais ..... F25D 25/024 62/338
5,355,686 A * 10/1994 Weiss ..... F25D 17/065 62/158
5,454,638 A * 10/1995 Bird ..... F25D 25/025 312/408

(Continued)

FOREIGN PATENT DOCUMENTS

DE 102010041952 A1 4/2012

*Primary Examiner* — Tavia Sullens

(74) *Attorney, Agent, or Firm* — Laurence A. Greenberg; Werner H. Stemer; Ralph E. Locher

(57) ABSTRACT

A household refrigerator has a receiving space for food, a back panel delimiting the receiving space at the back, a no-frost unit, and an air channel arranged behind the back panel and connected to the no-frost unit and has an outlet opening by which cold air from the no-frost unit can be introduced into the receiving space. A suction opening is provided by way of which air can be sucked out of the receiving space by the no-frost unit. The outlet opening and the suction opening are arranged at different levels. A baffle plate is arranged vertically between the outlet opening and the suction opening. The plate is arranged on the back panel and extends forwards in the direction of a loading opening, so cold air blown into the receiving space via the outlet opening flows around a leading edge of the baffle plate that faces the loading opening.

14 Claims, 5 Drawing Sheets

(56) References Cited

U.S. PATENT DOCUMENTS

| | | | | |
|---|---|---|---|---|
| 5,501,084 | A * | 3/1996 | Chang | F25D 17/042 62/264 |
| 8,845,047 | B2 * | 9/2014 | Luisi | F25D 23/069 312/407 |
| 2004/0040335 | A1 * | 3/2004 | Lee | F25D 17/065 62/419 |
| 2010/0181884 | A1 * | 7/2010 | De La Garza | F25D 25/024 312/408 |
| 2012/0011879 | A1 * | 1/2012 | Gu | F25D 23/069 62/408 |

* cited by examiner

NO-FROST HOUSEHOLD REFRIGERATOR HAVING BAFFLE PLATE PROVIDING A SEAL IN RELATION TO THE BACK PANEL

CROSS-REFERENCE TO RELATED APPLICATION

This application claims the benefit, under 35 U.S.C. § 119, of German patent application DE 10 2016 224 389.6, filed Dec. 7, 2016; the prior application is herewith incorporated by reference in its entirety.

BACKGROUND OF THE INVENTION

Field of the Invention

The invention relates to a household refrigerator having at least one receiving space for food. The household refrigerator contains a back panel by which the receiving space is delimited at the back. The household refrigerator contains a no-frost unit which is arranged behind the back panel. A household refrigerator has, moreover, an air channel which is connected to the no-frost unit and which has at least one outlet opening by way of which air from the no-frost unit can be introduced into the receiving space. The household refrigerator has, moreover, a suction opening by way of which air can be sucked out of the receiving space by the no-frost unit. The outlet opening and the suction opening are arranged at different levels, viewed in the vertical direction of the household refrigerator.

A no-frost household refrigerator of this kind is known, for example, from published, non-prosecuted German patent application DE 10 2010 041 952 A1. Formed in an upper region of the receiving space is a suction opening and in a lower region an outlet opening or a discharge opening. In the depth direction of the household refrigerator the two openings are essentially arranged at the same depth and are formed in a rear half of the receiving space. Owing to this arrangement of the openings, air circulation can possibly be circulated to only a limited extent over the entire receiving space, in particular only in a rear half of the receiving space since, as a result of the suction in the upper region, the air discharged at the bottom is possibly immediately sucked upwards again, so a corresponding section of the receiving space, in particular a region close to the door, is subject to this air circulation only under certain conditions.

SUMMARY OF THE INVENTION

It is the object of the present invention is to create a no-frost household refrigerator with which the cold air introduced by way of a no-frost unit and the air channel into the receiving space has improved circulation therein.

An inventive no-frost household refrigerator contains at least one receiving space for food. The household refrigerator has a back panel by which the receiving space is delimited at the rear. The no-frost household refrigerator has a no-frost unit which is arranged behind the back panel. The household refrigerator has, moreover, an air channel which is connected to the no-frost unit and which has at least one outlet opening by way of which cold air from the no-frost unit can be introduced into the receiving space. The household refrigerator has, moreover, at least one suction opening by way of which air from the receiving space can be sucked out of the receiving space by the no-frost unit. Viewed in the vertical direction of the household refrigerator, and therefore in the height direction, the at least one outlet opening and the at least one suction opening are arranged at different levels. A fundamental idea of the invention can be seen in that, viewed in this height direction of the household refrigerator, a baffle plate is arranged between the levels of the outlet opening and the suction opening, which plate is arranged on the back panel and extends forwards from the back panel in the direction of a loading opening of the receiving space, so cold air blown into the receiving space by way of the outlet opening flows around a leading edge of the baffle plate that faces the loading opening. A design of this kind enables more extensive and improved air distribution of the introduced cold air in the receiving space in a no-frost household refrigerator. The air is then circulated throughout the receiving space, so temperature control is more uniform and air is exchanged more uniformly here as well. Storage conditions can also be improved for the food as a result. It is precisely the baffle plate extending, in particular, horizontally, and therefore in the depth direction, and its local attachment as well as the specific attachment on the back panel that means that there is no direct connection between the outlet opening and the suction opening close to the back panel, so the blown-in air cannot immediately flow along the back panel and be removed again by suction. This is prevented by the baffle plate and fastening to the back panel and the inevitable flowing of the cold air that then also occurs forwards in the direction of the loading opening and around the baffle plate enables more uniform air circulation. A more uniform air stratification in the receiving space is also enabled as a result.

The no-frost unit has an evaporator which is also separated from the receiving space by the back panel. In particular, the no-frost unit has a fan. The evaporator is, in particular, vertically oriented, and this means that it extends with its planar extent in the height direction of the household refrigerator in the region of the back panel.

The baffle plate is preferably connected to the back panel in an air-tight manner. This means that it is precisely at this interface between the baffle plate and the back panel that a particularly tight connection is formed in respect of the passage of air. The air introduced into the receiving space at the back panel by way of the outlet opening is consequently prevented from flowing as far as the suction opening. The baffle plate is advantageously arranged on the back panel in such a way that a labyrinth is produced which prevents the passage of air.

Viewed in the depth direction of the household refrigerator, the baffle plate is preferably formed over at least 60%, in particular at least 75% of the spacing between the back panel and the loading opening measured in the depth direction. This means that the baffle plate extends over a relatively large section between the back panel and the loading opening, so when the cold air flows over the leading edge of the baffle plate, this cold air is also distributed over the entire receiving space and, in particular, also flows forwards as far as the loading opening.

The baffle plate provides an auxiliary tool which influences the flow of the introduced cold air. The baffle plate is therefore also a flow directing element in the receiving space, with which the targeted flow behavior of the cold air introduced by way of the outlet opening is predefined.

In the width direction of the household refrigerator the baffle plate preferably extends over the entire width of the receiving space, so the cold air does not undesirably flow past on a short cut to the outlet opening at these edge regions either.

It is preferably provided that the household refrigerator has a front block separate from the back panel and which is arranged on the back panel and/or on the no-frost unit, and on which the baffle plate is arranged. Fitting of the back panel and the mechanically stable attachment precisely at this interface with the back panel is improved by a design of this kind.

However, it can also be provided that the back panel has a receiver, for example a groove, which can preferably be integrated in the back panel, into which a rear region of the baffle plate can then be introduced. A front block that is separate in this respect would then not be necessary here.

In the design with a front block it is preferably provided that the front block sits on the no-frost unit and is connected, in particular is latched, to the no-frost unit. A connection of this kind that can be detached without being destroyed has advantages during assembly and disassembly, so maintenance and replacement work can also be completed very easily. Furthermore, the front block is then also fastened in a mechanically stable manner and can safely receive the baffle plate.

It is preferably provided that the front block has an upwardly protruding hook which is configured for fastening the front block to the back panel and engages behind the back panel in the assembled state. It is therefore possible to hang this front block on the back panel, so precisely a tilting movement of the front block with baffle plate is prevented in the assembled end position.

The front block preferably has a receiving groove that is open in the direction of the loading opening, into which the baffle plate extends with a rear plate region in the assembled state. This embodiment prevents the baffle plate from undesirably tilting out, since the baffle plate is also held from above in this rear plate region. This occurs by way of an upper limiting panel, which delimits the receiving groove.

A rear plate region of the baffle plate is preferably received in a separate profiled part which encompasses the plate region. This separate profiled part firstly creates a mechanically stable rail which robustly enables a coupling with the front block when the front block is present in an advantageous design. The baffle plate is therefore protected in this trailing rear plate region, so even repeated removal or re-insertion of the baffle plate does not entail any damage to this rear panel region. Furthermore, this separate profiled part can provide a material- and shape-specific individual part which is more capable of withstanding the demands during assembly and disassembly as well as the force effects that then occur in the installed state.

It is preferably provided that the profiled part has a coupling pin which engages in a receiver in the baffle plate. Position fixing between the profiled part and the baffle plate is also achieved as a result. In particular, a relative movement between the profiled part and the baffle plate in the depth direction of the household refrigerator is therefore prevented, so in the assembled end position the baffle plate cannot be undesirably pulled out by itself at the front. This embodiment creates a simple and highly effective safety mechanism.

In the assembled state of the baffle plate the profiled part is preferably arranged in the receiving groove. A force fit can also be formed. Particularly stable positioning and an airtight embodiment is then made possible.

It is preferably provided that formed at a side panel, which delimits the receiving space, is a receiving recess that is oriented in the depth direction of the household refrigerator and is open at the top in the height direction, in which recess the profiled part is arranged counter-sunk in the assembled state of the baffle plate. This embodiment enables a further improved bearing fit of the baffle plate and, in particular, prevents slipping in depth direction of the household refrigerator. Undesirable removal of the baffle plate with the profiled part from the receiving groove of the front block is consequently prevented. Nevertheless, this embodiment can provide a simple front block with a uniform receiving groove, so this front block can accordingly be easily manufactured. Not least of all, an embodiment of this kind also achieves a simple assembly scenario which accurately enables insertion of the baffle plate, in particular with the profiled part, in a receiving groove of the front block with a preferred design and then by way of a simple pivoting movement of the baffle plate with the profiled part, the horizontal end position of this baffle plate can be reliably attained in which this profiled part is then also counter-sunk in this receiving recess at the side panel and a mechanism to prevent it being pulled out is achieved.

Viewed in the height direction of the household refrigerator, the receiving recess is open at the top, delimited at the bottom by a limiting panel and also limited at the front by a limiting panel.

The receiving recess is preferably formed so as to be integrated in the side panel. This minimizes the number of components and reduces the effort required for assembly. It is precisely when this side panel is made from plastics material and is part of an inner container, which delimits the receiving space, that it is therefore not necessary for assembly holes or the like to exist which would when then possibly also impair the thermal insulating effect, because outside of this side panel, and therefore on the surface of this side panel remote from the receiving space, thermally insulating material is introduced in a gap between the inner container and an outer housing of the housing of the household refrigerator. The integrated or, in particular, attached design of the receiving recess in this plastics material part, namely the side panel, means no screws of this kind or the like are necessary, so the thickness of the thermally insulating material does not then have to be reduced in the region of this side panel.

It is preferably provided that in the assembled end position, the baffle plate rests on a supporting web which is formed on a side panel which delimits the receiving space. This side panel is also, in particular, that of the inner container, so it is preferably also provided here that the supporting web is formed so as to be integrated at this side panel. This is a further advantageous design since, therefore, not only is the mechanical coupling of the baffle plate formed in the region of the back panel, but mechanical contacts are also laterally present on these side panels, namely the supporting webs. A purely self-supporting baffle plate, which is mechanically attached only in the region of the back panel, is consequently avoided. The baffle plate therefore also rests stably on these supporting webs, so their bearing load is significantly increased.

Functionally, the baffle plate is also configured, in particular, as a compartment base, so items for storage can also be placed on this baffle plate in the assembled end position. It is precisely when these supporting webs are present that a greater bearing capacity can also be achieved here.

The baffle plate is preferably made from glass. This has advantages in that the baffle plate separates the receiving space essentially into two separate sections or partial volumes and as a result of the design made from glass, a transparent design is therefore achieved in which shadowing occurs. Illumination of the receiving space by one or more lighting device(s) is then possible unhindered and the passage of the light, which is irradiated into one of these partial volumes of the receiving space, can then also pass through the baffle plate at least proportionally into the other section of the receiving space.

It is preferably provided that a limiting bead of the receiving recess ends in the supporting web. A very compact and uniform concept is achieved thereby, so even the respective end positions of the profiled part in the receiving recess and the baffle plate on the supporting web are jointly achieved since no position tolerances occur between the receiving recess and the supporting web.

It is preferably provided that the household refrigerator has a first receiving space which is a refrigerator compartment, wherein the first receiving space can be sealed by two separate doors, which can each be pivoted about a vertical axis. The household refrigerator has, moreover, at least one second receiving space which is configured so as to be separate from the first receiving space, with the second receiving space being a freezer compartment. The second receiving space can be sealed by a further separate third door, in particular a front panel of a drawer that can be pushed into and pulled out of the second receiving space.

In respect of their design and height, appliances of this kind are configured in such a way that the conventional installation of no-frost units, as is provided, in particular, in the region of a top panel, which seals the receiving space, is not expedient. With these known designs the no-frost units are conventionally installed horizontally, which means that, in the depth direction, an evaporator of the no-frost unit extends along this top panel. Since this no-frost unit also has a certain overall height, in an above-mentioned advantageous household refrigerator having these two receiving spaces, this no-frost unit will be disruptively in the way not just for the observer's gaze. It is preferably provided in these specific household refrigerators that the no-frost unit is installed upright or vertically, which means that the evaporator of the no-frost unit is not oriented horizontally but vertically. It is therefore advantageous precisely with these appliances if this no-frost unit is installed upright and therefore vertically and is arranged in a lower back region of the first receiving space. In particular, this results in an advantageous constellation to the extent that the at least one outlet opening is arranged above the at least one suction opening in the vertical direction. It is precisely with a concept of this kind that the inventive embodiment is then of particular significance since this therefore enables air circulation that is completely distributed over the entire receiving space.

A plurality of outlet openings is preferably formed and these are arranged at different levels. In particular, at least two suction openings are formed which are preferably arranged at the same level in the height direction and are arranged at a spacing in the width direction.

This kind of specific positioning of a no-frost unit means that this is not in the way even when cleaning side panels or a top panel, which delimit the receiving space. Cleaning is also simplified thereby.

A no-frost household refrigerator is fitted with no-frost technology which has a no-frost unit. No-frost technology designates a technical method in which the humidity in an interior designed as a freezer compartment is reduced. As a result, the food does not ice up, or icing up is much reduced, and defrosting of the freezer compartment can be dispensed with or only has to be carried out in much reduced time cycle. With no-frost technology of this kind, cooling elements designed, for example, as cooling fins, and therefore a heat exchanger of the secondary circuit, are located in a separate region in the interior. During the cooling phase the cold air is then introduced by a fan from this separate region into the interior and therefore the freezer compartment. These appliances are designed in such a way that air circulates through all compartments of the interior and enters as a circuit into the separate region again. Since cold air holds less moisture, this condenses as frost predominantly only on the heat exchanger of the secondary refrigeration circuit, which is located in the separate region, and is the coldest point in the no-frost household appliance which has contact with air. It can then be provided that in specific intervals a defrost mode is implemented in which this first heat exchanger in the separate region is defrosted. For this purpose, a heater in particular is provided in the no-frost household refrigerator by which this heat exchanger is heated. The water then resulting from the defrosting layer of ice can run out of the interior by way of a run-off channel, and therefore also out of the appliance, and can be collected in a collecting tray which can also be used as an evaporation container. In particular, the fan is deactivated in defrost mode, so the freezer compartment continues to remain cooled. Icing up of cooling ribs is significantly reduced by no-frost technology and the humidity throughout the entire household refrigerator is reduced, so the formation of layers of ice is also significantly reduced.

The humidity in the freezer compartment is significantly reduced in a no-frost appliance by an exemplary, relatively simple method. This is achieved, in particular, by separation of the cooling fins from the actual cooling region or refrigerator compartment, with the cold air being conveyed with the aid of a fan into the interior of the freezer or the freezer compartment. The cold air circulates as a circuit through all compartments of the refrigerator and enters the cooling part again. Since it can absorb the moisture only poorly, and cannot retain it well, the moisture condenses on the cooling fins. These are heated and defrosted at regular intervals and the water preferably passes, for example via a channel, into an evaporation container. The humidity is reduced throughout the appliance and almost no layers of ice form. In contrast to conventional appliances, most of the resulting moisture, which leads to icing up of the conventional freezers, collects in the separate region of the cooling fins in the household refrigerator with no-frost technology.

The details "top", "bottom", "front", "back", "horizontal", "vertical", "depth direction", "width direction", "height direction", etc. indicate the positions and orientations when the appliance is properly used and properly arranged and in the case of an observer stood in front of the appliance and looking in the direction of the appliance.

When reading the claim language, the following definitions apply. When the claim language recites A and/or B it means A alone, B alone or A and B. When the claim language recites at least one of A and B it means A alone, B alone or A and B. When the claim language recites at least one of A or B it means A alone, B alone or A and B.

Further features of the invention emerge from the claims, figures and description of the figures. The features and feature combinations mentioned in the description above, as well as the features and feature combinations mentioned below in the description of figures and/or shown in the figures alone can be used not just in the respectively disclosed combination, but also in other combinations without departing from the scope of the invention. Embodiments of the invention, which are not explicitly shown and described in the figures but emerge from the statements made and can be generated by separate feature combinations, should therefore also be regarded as encompassed and disclosed. Embodiments and feature combinations which therefore do not have all features of an originally worded independent claim should also be regarded as being disclosed. Furthermore, embodiments and feature combinations, in particular as a result of the statements presented above, which go beyond or deviate from the feature combinations presented in the references in the claims, should be regarded as being disclosed.

Other features which are considered as characteristic for the invention are set forth in the appended claims.

Although the invention is illustrated and described herein as embodied in a no-frost household refrigerator having baffle plate providing a seal in relation to the back panel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
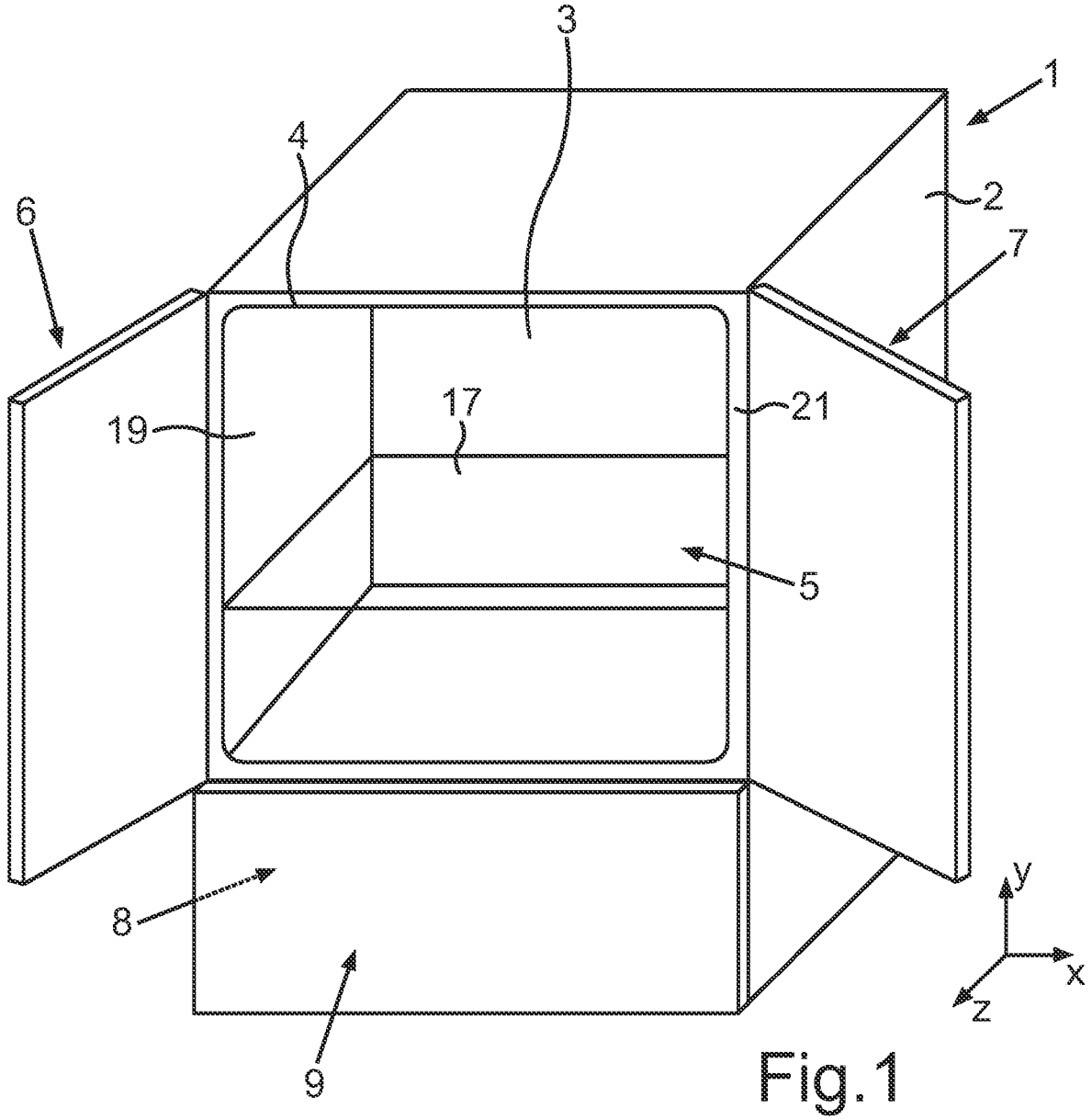
FIG. 1 is a diagrammatic, perspective view of an exemplary embodiment of an inventive household refrigerator.

Identical elements or those with the same function are provided with identical reference numerals in the figures.

Referring now to the figures of the drawings in detail and first, particularly to FIG. 1 thereof, there is shown in a schematic view a household refrigerator 1 which is configured for storing and conserving food. The household refrigerator 1 is a fridge-freezer here. It has a housing 2 in which a first receiving space 3 is formed, which is a refrigerator compartment in the exemplary embodiment. The first receiving space 3 is delimited by panels of an inner container 4. At the front, the inner container 4, and therefore also the first receiving space 3, has a loading opening 5 which can be sealed by two separate doors 6 and 7. The loading opening 5 is a continuous opening without interruption and the first receiving space 3 is also a continuous space without interruption. The two doors 6 and 7 are pivotally arranged on the housing 2 by way of vertically oriented pivot axes in each case, which are therefore oriented in the height direction (y-direction).

In the exemplary embodiment the household refrigerator 1 has, moreover, a second receiving space 8 that is separate from the first receiving space 3, and which is a freezer compartment here. Viewed in particular in the vertical direction and therefore in the height direction, the second receiving space 8 is arranged beneath the first receiving space 3. In the height direction the two receiving spaces 3 and 8 are arranged so as not to overlap. The second receiving space 8 can be sealed at the front by a separate third door 9, wherein this door 9 is formed, in particular a front panel of a drawer that can be displaced in the depth direction (z-direction), which can be pushed into and pulled out of the second receiving space 8. The doors 6, 7 and 9 are arranged so as not to overlap each other and are positioned side by side at the front. In particular they are front end parts or visible parts of the household refrigerator 1.

Figure 2:
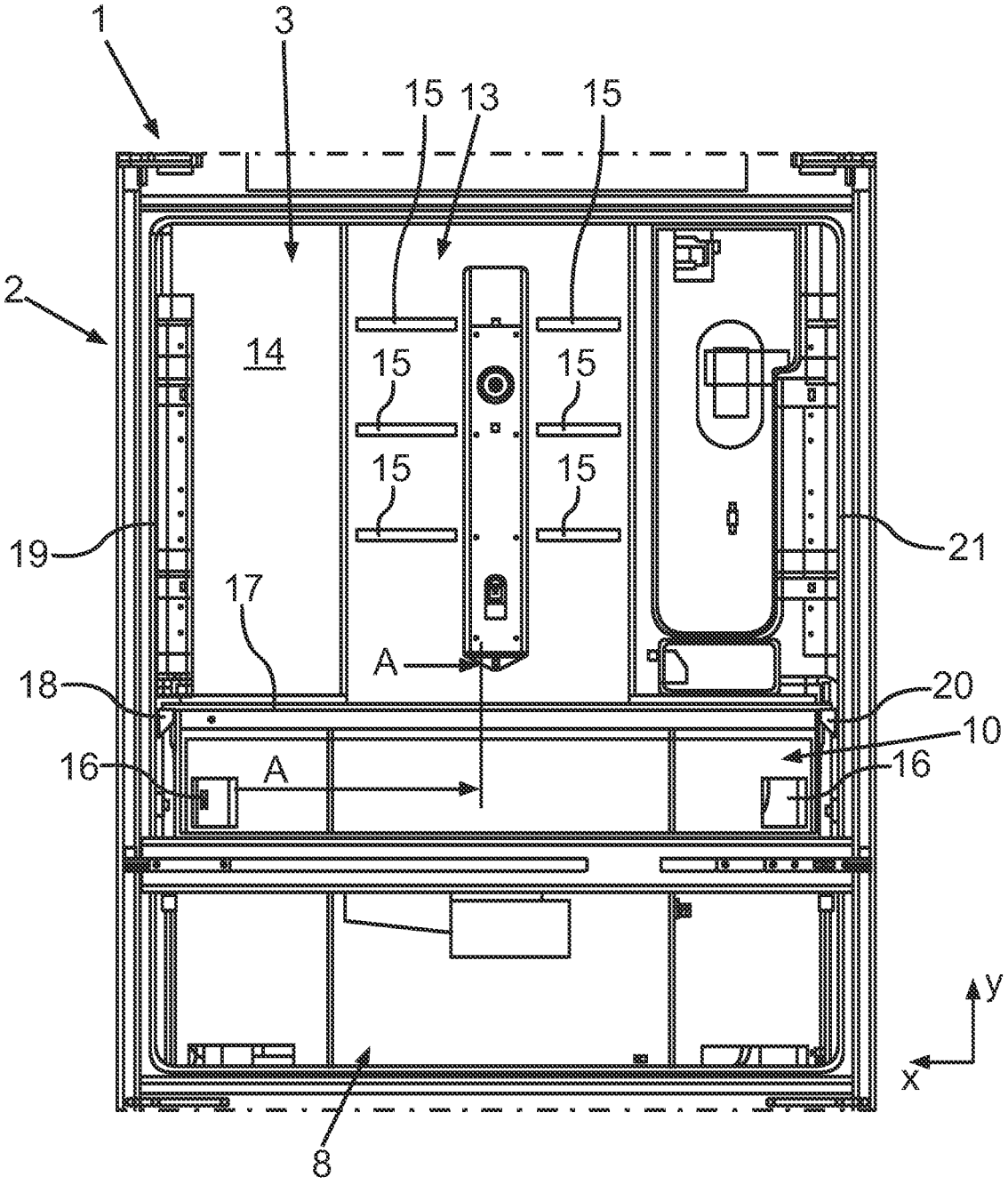
FIG. 2 is a simplified front view of the household refrigerator according to FIG. 1 with removed doors.

FIG. 2 shows the household refrigerator 1, which is a no-frost household refrigerator, in a front view and without the doors 6, 7 and 9. The household refrigerator 1 contains a no-frost unit 10 which is installed upright and is therefore oriented in the vertical direction. The no-frost unit 10 has an evaporator which cannot be seen in FIG. 2 and is illustrated symbolically in the section in FIG. 3 as an evaporator 11. The no-frost unit 10 contains, moreover, a fan 12 (FIG. 3), with which cold air generated in the region of the evaporator 11 is circulated in the household refrigerator 1.

The no-frost unit 10 is formed in a lower back region of the first receiving space 3. The no-frost unit 10 also extends, in particular, into the second receiving space 8 and is also arranged in the back region there.

The household refrigerator 1 contains, moreover, an air channel 13 (FIG. 2), which is formed behind a back panel 14. The back panel 14 delimits the first receiving space 3 in the depth direction at the back. The back panel 14 is, in particular, a separate casing panel which at least partially covers a back panel of the inner container 4 in the direction of the receiving space 3. An air channel 13 is coupled to the no-frost unit 10 for air circulation and in the exemplary embodiment has a plurality of outlet openings 15 which are arranged in pairs at the same level, but are then formed, moreover, at different levels in the height direction (y-direction).

Furthermore, two suction openings 16 are provided in the exemplary embodiment and, viewed in the height direction, these are arranged at a lower level than the outlet openings 15. The two suction openings 16 preferably provided here are arranged at a maximum spacing from each other in the width direction, but are arranged at the same level. By way of the suction openings 16 air is sucked out of the receiving space 3 into the no-frost unit 10, and this occurs by way of the fan 12 that sucks in air in this regard. The cold air is then conducted by way of this fan 12 to the air channel 13 and is blown from there by way of the outlet openings 15 already discussed into the receiving space 3. The no-frost unit 10 is separated from the receiving space 3 by the back panel 14.

The household refrigerator 1 has, moreover, a baffle plate 17, which is shown in FIG. 2 in its assembled end position. The baffle plate 17 is, in particular, a glass plate which preferably extends over the entire width of the receiving space 3. The baffle plate 17 rests on a first supporting web 18 which is formed on a first side panel 19. In particular, the supporting web 18, which can also be called a support rib, is configured in one piece on the side panel 19. The side panel 19 delimits the receiving space 3 and is part of the inner container 4.

A further supporting web 20 is formed at the opposing side, and this is similarly configured in one piece on an opposing second side panel 21, in particular is integrated. The side panel 21 is also a component of the inner container 4.

Functionally, the baffle plate 17 is configured as a flow directing element and also as a compartment base.

Figure 3:
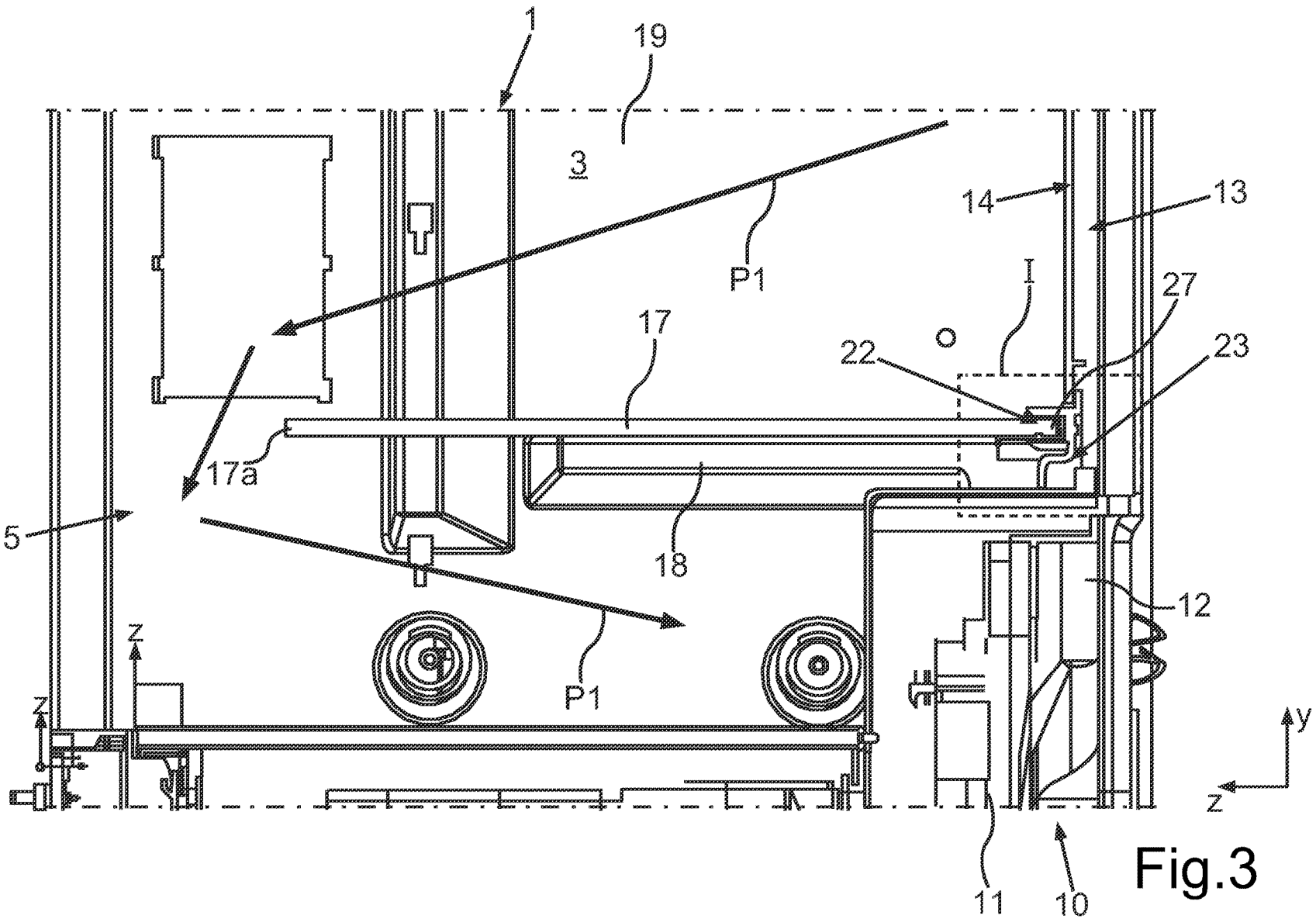
FIG. 3 is a vertical sectional view through the household refrigerator according to FIG. 1 in a section in which a baffle plate is assembled.

FIG. 3 shows in a vertical section (x-z plane) the household refrigerator 1 in the region of the baffle plate 17. It can be seen here that cold air which is blown in by way of the outlet openings 15 into the receiving space 3 and is illustrated by the arrow P1, does not flow downwards again directly along the back panel 14 and is not sucked in accordingly. Instead, it has to flow around a leading edge 17*a* of the baffle plate 17 remote from the back panel 14 and only then does it arrive at the suction openings 16 again. As can be seen, the baffle plate 17 extends in the horizontal direction and extends forwards from the back panel 14 to the loading opening 5. As can be seen here, in the depth direction the baffle plate 17 has an extent which measures at least 60%, in particular at least 75% of the spacing between the back panel 14 and the loading opening 5 measured in this depth direction. The baffle plate 17 therefore extends relatively far forwards, so air flows around in such a way that the cold air also has to flow forwards as far as the loading opening 5 and therefore the cold air is very uniformly and extensively distributed in the receiving space 3. Very uniform air stratification is therefore enabled in the receiving space 3.

Figure 4:
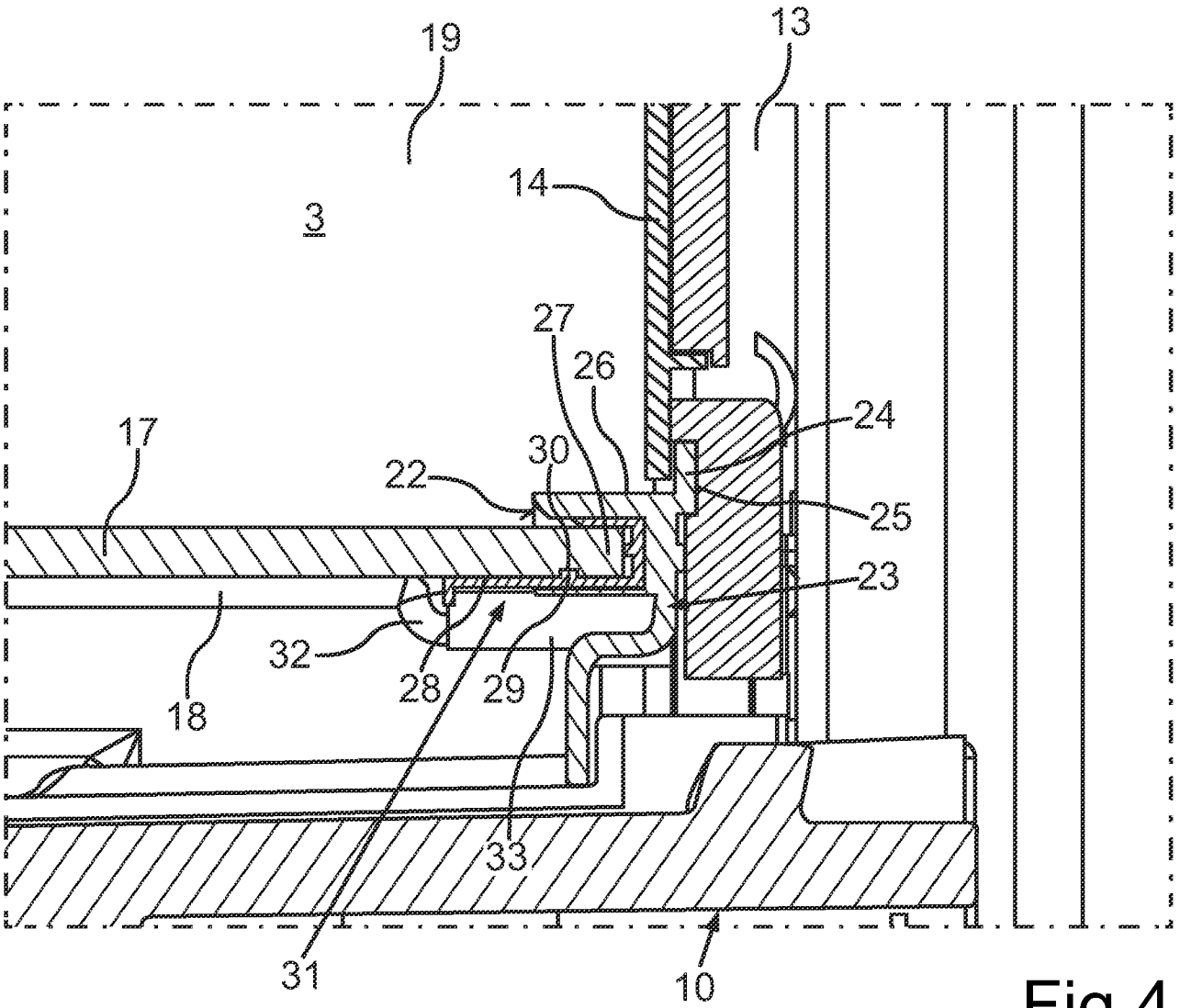
FIG. 4 is an enlarged, sectional view of a detail of FIG. 3.

The baffle plate 17 is non-destructively detachably arranged on the back panel 14. FIG. 4 shows an enlarged view of the detail I in FIG. 3. It can be seen that the baffle plate 17 submerges into a receiving groove 22. The receiving groove 22 is part of a front block 23, which is a separate component. The front block 23 sits on the no-frost unit 10, in particular is latched thereto. Furthermore, it is provided in particular that the front block 23 also engages behind the back panel 14. For this purpose, the front block 23 contains a hook 24 which is configured to project upwards and, as can be seen in FIG. 4, engages behind the back panel 14. It engages in a pocket 25 in the process. The receiving groove 22 that is open at the front, and therefore in the direction of the loading opening 5, is closed at the top and, more precisely, by a top panel 26 of the front block 23. As a result, the baffle plate 17 cannot escape upwardly and is accordingly held. The baffle plate 17 submerges with a back region or a rear plate region 27 into this receiving groove 22.

In an advantageous embodiment it is provided that a separate profiled part 28 is formed which is configured separately to the baffle plate 17 and the front block 23. This profiled part 28 encompasses the back edge and also the rear plate region 27 of the baffle plate 17. In the assembled end state shown in FIG. 4, the profiled part 28 is arranged submerged in this receiving groove 22 of the front block 23. As a result of this embodiment, the baffle plate 17 is firstly mechanically stably arranged at the attachment point to the back panel 14, and secondly, arranged so it can be easily assembled and disassembled and is especially air-tight. This means that no air can pass through at the interface between the baffle plate 17 and the back panel 14 and a corresponding locking labyrinth is formed here. It is advantageously provided that the profiled part 28 has a coupling pin 29 which is configured to project upwards and which engages in a receiver 30 in particular at the lower side of the baffle plate 17. As a result, the baffle plate 17 is also fixed in position with the profiled part 28 and cannot slide out or be pulled out in the depth direction.

In a further advantageous embodiment, it is provided that a receiving recess 31 is formed on the side panel 19. In the assembled end state, the profiled part 28 can be received in the receiving recess 31, which is open in the height direction, but on the other hand is delimited at the bottom and at the front by beaded panels 32 and 33. As a result, the profiled part 28 is secured against slipping out in the depth direction and therefore cannot be undesirably pulled forwards out of the receiving groove 22. The receiving recess 31 with the delimiting panels 32, 33 preferably ends in the supporting web 18. In particular, these delimiting panels 32, 33, which delimit the receiving recess 31 at the bottom and at the front, are configured so as to be integrated in the side panel 19.

In particular, the baffle plate 17 is also accordingly configured to face the opposing side and therefore the side panel 19, as is shown and illustrated in FIG. 4 in the region of the first side panel 19.

Figure 5:
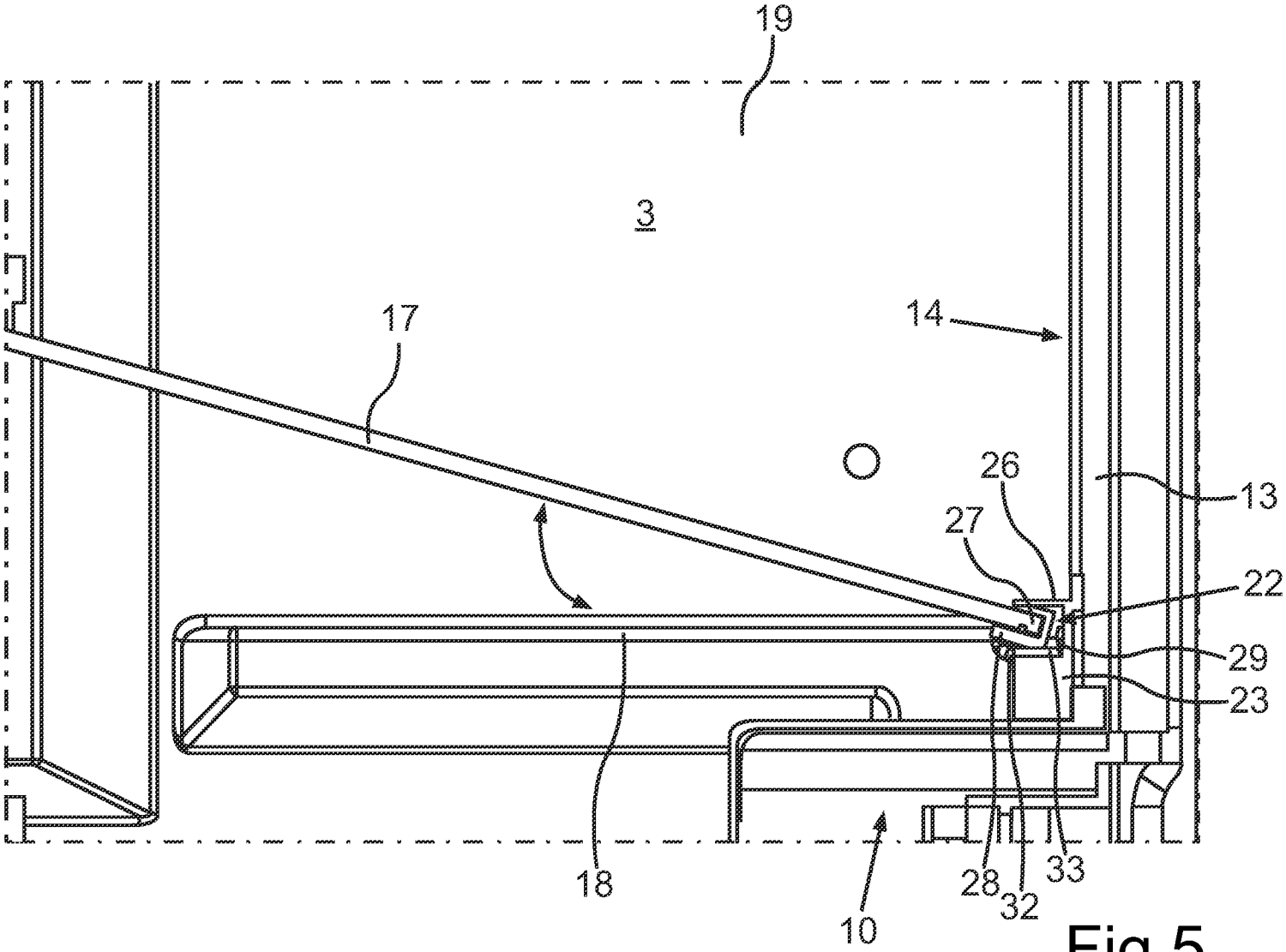
FIG. 5 is a view according to FIG. 3 with the baffle plate in an intermediate assembly position.

FIG. 5 shows the view according to FIG. 3, with the baffle plate 17 being shown in an intermediate assembly position here. Starting from the view in FIG. 3, in which the baffle plate 17 is in the assembled end position, the plate can also be removed. For this purpose, the baffle plate 17 can be pivoted upwards, so the baffle plate 17, in particular together with the optionally present profiled part 28, may be pivoted out of the receiving groove 22 of the front block 23. This upwards pivoting movement means the baffle plate 17 is positioned in such a way that it can be pulled out of the receiving recess 31 in that it is tilted and is then pulled forwards and upwards. In particular, the top panel 26, which delimits the receiving groove 22, is accordingly designed to be elastically deformable. During insertion of the baffle plate 17 this procedure takes place in the reverse order, so the tilted baffle plate 17 with the especially present profiled part is then pushed obliquely from above into the receiving groove 22 until the geometry of the receiving recess 31 allows pivoting downwards, so then this back region of the baffle plate 17 with the profiled part 28 can be brought completely into the end position in the receiving groove 22, as is then shown in FIG. 3. The profiled part 28 is then also arranged in this groove fully submerged in the receiving recess 31. It can advantageously be provided that in its leading free edge this top panel 26 is formed at a slight angle in the direction of the receiving recess 31, so insertion or removal of the baffle plate 17 is simplified. This means that this leading free end of the top panel 26 is tapered.

The following is a summary list of reference numerals and the corresponding structure used in the above description of the invention:

1 household refrigerator
2 housing
3 first receiving space
4 inner container
5 loading opening
6 door
7 door
8 second receiving space
9 door
10 no-frost unit
11 evaporator
12 fan
13 air channel
14 back panel
15 outlet opening
16 suction opening
17 baffle plate
17*a* leading edge
18 first supporting web
19 first side panel
20 second supporting web
21 second side panel
22 receiving groove
23 front block
24 hook
25 pocket
26 top panel
27 rear plate region

28 profiled part
29 coupling pin
30 receiver
31 receiving recess
32 limiting panel
33 limiting panel
P1 arrow

The invention claimed is:

1. A household refrigerator, comprising:

an inner container defining at least one receiving space having a loading opening for food, and having a back panel by which said receiving space is delimited at a rear of the refrigerator;

a no-frost unit;

an air channel disposed behind said back panel and connected to said no-frost unit, said air channel having at least one outlet opening for introducing cold air from said no-frost unit into said receiving space, and a suction opening for suction of air out of said receiving space with said no-frost unit, said outlet opening and said suction opening being disposed at different levels; and a baffle plate having a leading edge facing said loading opening and a rear plate region opposite said leading edge, said baffle plate being disposed between said outlet opening and said suction opening in a height direction of the refrigerator, said baffle plate being disposed on said back panel and extending forwards from said back panel in the direction of said loading opening of said receiving space, so that the cold air blown into said receiving space by way of said outlet opening flows around said leading edge, said baffle plate has a receiver being a blind aperture formed in an underside of said baffle plate;

a separate profiled part, said rear plate region of said baffle plate being received in said separate profiled part, said separate profiled part having a coupling pin engaging in said receiver of said baffle plate.

2. The household refrigerator according to claim 1, wherein said coupling pin engages in said receiver of said baffle plate to positionally fix said baffle plate to said separate profiled part in the depth direction.

3. The household refrigerator according to claim 1, wherein said separate profiled part encompasses said rear plate region.

4. A household refrigerator, comprising:

an inner container defining at least one receiving space having a loading opening for food, and having a back panel by which said receiving space is delimited at a rear of the refrigerator;

a no-frost unit;

an air channel disposed behind said back panel and connected to said no-frost unit, said air channel having at least one outlet opening for introducing cold air from said no-frost unit into said receiving space, and a suction opening for suction of air out of said receiving space with said no-frost unit, said outlet opening and said suction opening being disposed at different levels; and a baffle plate having a leading edge facing said loading opening and a rear plate region opposite said leading edge, said baffle plate being disposed between said outlet opening and said suction opening in a height direction of the refrigerator, said baffle plate being disposed on said back panel and extending forwards from said back panel in the direction of said loading opening of said receiving space, so that the cold air blown into said receiving space by way of said outlet opening flows around said leading edge;

a separate profiled part, said rear plate region of said baffle plate being received in said separate profiled part;

said inner container having a side panel delimiting said receiving space, a receiving recess formed on said side panel and oriented in a depth direction of the household refrigerator, said receiving recess receiving said separate profiled part in an assembled end position of said baffle plate;

said side panel having a supporting web formed thereon, said supporting web having a supporting surface and said baffle plate resting on said supporting surface in said end position of said baffle plate, said receiving recess having a beaded panel ending in said supporting web, said receiving recess being countersunk with respect to said supporting surface.

5. The household refrigerator according to claim 4, wherein said baffle plate is connected to said back panel in an air-tight manner.

6. The household refrigerator according to claim 4, wherein when viewed in the depth direction of the household refrigerator, said baffle plate extends over at least 60% of the spacing between said back panel and said loading opening measured in the depth direction.

7. The household refrigerator according to claim 4, wherein in the depth direction of the household refrigerator, said baffle plate extends over at least 75% of the spacing between said back panel and said loading opening measured in the depth direction.

8. The household refrigerator according to claim 4, wherein:

said baffle plate has a receiver; and said separate profiled part has a coupling pin which engages in said receiver of said baffle plate.

9. The household refrigerator according to claim 4, further comprising doors; and wherein said at least one receiving space includes a first receiving space which is a refrigerator compartment, wherein said first receiving space can be sealed by first and second separate ones of said doors that can be pivoted about one vertical axis respectively, and said at least one receiving space includes a second receiving space separate from said first receiving space, said second receiving space is a freezer compartment, said second receiving space is sealed by a separate third one of said doors.

10. The household refrigerator according to claim 9, further comprising a drawer that can be pushed into and pulled out of said second receiving space, said drawer having a front panel being said third door.

11. The household refrigerator according to claim 4, further comprising a front block being separate from said back panel and being disposed on at least one of said back panel or on said no-frost unit, said baffle plate being disposed on said front block.

12. The household refrigerator according to claim 11, wherein said front block sits on said no-frost unit and is latched to said no-frost unit.

13. The household refrigerator according to claim 11, wherein said front block has an upwardly protruding hook which engages behind said back panel for fastening said front block to said back panel.

14. The household refrigerator according to claim 11, wherein said front block has a receiving groove formed therein and in an assembled state, said separate profiled part extends into said receiving groove.

* * * * *